United States Patent [19]

Hurst

[11] Patent Number: 4,884,793

[45] Date of Patent: Dec. 5, 1989

[54] PICKER-STRIPPER-FEEDER FOR ENVELOPE FEEDING APPARATUS

[76] Inventor: Richard F. Hurst, 126 Steeplechase Rd., Devon, Pa. 19333

[21] Appl. No.: 65,292

[22] Filed: Jun. 22, 1987

[51] Int. Cl.[4] ..... B65H 3/26

[52] U.S. Cl. ..... 271/2; 271/129; 271/140; 271/149

[58] Field of Search ..... 271/2, 31.1, 129, 139, 271/140, 149, 150, 184, 185; 400/626

[56] References Cited

U.S. PATENT DOCUMENTS

| | | | |
|---|---|---|---|
| 1,008,961 | 11/1911 | Doane | 400/626 X |
| 1,346,605 | 7/1920 | Mapes | 400/626 |
| 1,481,494 | 1/1924 | Wood | 400/626 |
| 1,817,235 | 8/1931 | Chenery | 400/626 |
| 2,038,645 | 4/1936 | Cherry | 271/2 |
| 2,085,464 | 6/1937 | French | 400/626 |
| 2,554,577 | 5/1951 | Lauffer | 271/2 |
| 2,572,509 | 10/1951 | Novick | 271/150 |
| 4,736,939 | 4/1988 | Smerke | 271/184 |

*Primary Examiner*—Richard A. Schacher
*Attorney, Agent, or Firm*—John B. Sowell

[57] ABSTRACT

Apparatus for stripping a single envelope from a stack of envelopes without misfeeding or double feeding is provided. The apparatus includes a picker blade which is articulated by a drive to impart of plurality of motions to the leading edge of an envelope after the picker blade has been engaged under the flap of an envelope to be separated from a stack of envelopes in a magazine. The novel stripping action of the picker blade ensures that the leading edge only of the envelope to be fed from the magazine is first stripped and separated from the stack of envelopes and directed past a restrainer which prevents the stack of envelopes adjacent the envelope to be fed from being moved in a feed direction.

19 Claims, 4 Drawing Sheets

PICKER-STRIPPER-FEEDER FOR ENVELOPE FEEDING APPARATUS

BACKGROUND OF THE INVENTION

1. Field of the Invention

The present invention is related to continuous envelope feeders of the type adapted to be used in conjunction with printers or labelers which place information on the envelope. More particularly, the present invention relates to novel apparatus for stripping a single envelope from a stack of envelopes without jamming or feeding two envelopes.

2. Description of the Prior Art

U.S. Class 271, Subclass 2 contains sheet feeding or delivering apparatus/envelopes and contains patents dating before 1900 which teach envelope feeders. Prior art envelope feeders have recognized the problem that it is impossible to stack envelopes horizontally, vertically or otherwise in a magazine and to remove a single envelope in every instance. The prior art devices are capable of operating correctly most of the time but not all of the time. The friction that occurs between a stack of envelopes in a magazine is effected by pressure, temperature, humidity and also the thickness of the envelope as well as the surface texture. When these conditions combine it is possible to feed one envelope mechanically and have the adjacent envelope adhere thereto causing a double feed of envelopes. None of the prior art in the aforementioned Class 271, Subclass 2 deal directly with this problem nor does it offer a hundred percent solution. For example, U.S. Pat. No. 2,267,574 is directed to an envelope feeding mechanism which opens the flap of the envelope so as to permit pinch rolls to pull the flap and trailing envelope out of a magazine. By opening a single flap from the bottom envelope the pinch rolls are only capable of grasping one envelope from the magazine at a time. Even this teaching has no provision for preventing the closed envelope stacked on top of the open envelope from adhering to the envelope being fed into the pinch rolls and double feeding of envelopes is possible. Moreover, there are numerous modern day printers such as carriage printers and laser printers which require that the flap of the envelope be closed in order to fit properly into the feed mechanism of the printer and devices such as this teaching will require an additional mechanism to close the flap before being used in such printers.

As a second example U.S. Pat. No. 2,521,237 teaches an envelope printing press which has a self-contained rotary print roller. A vertical magazine of envelopes with flaps down is mounted adjacent to the roll printer and a second roll having spring fingers at its outer edges engages under the end portions of the flap of the envelope positioned in the magazine so as to pull the envelope out of the magazine and into the gap formed between the rotary print roll and the pinch roll. Again, if adverse conditions occur the envelope being pulled from the magazine will also carry a second envelope into the printing press. Another example of a printing press feeder is provided in U.S. Pat. No. 1,724,199 which employs a sliding plate. The slide plate is designed to slip under the flap of an envelope loaded in a magazine with its flap down. To assure that the slide plate does not slide past an envelope and does select at least one envelope a plurality of vacuum holes are provided opposite the loose flap so as to separate the loose flap from the envelope to allow the slide plate to feed one envelope. Under adverse conditions more than one envelope can be fed into the printing press.

Advances in adhesive technology have substantially overcome the problem of flaps on envelopes self-sealing due to minor changes in humidity or as a result of being stacked vertically. However, modern technology has provided the user with standard business envelopes that have six layers of thickness at the center portion and only two layers of thicknesses over the major portion of the envelope. In addition to non-uniformity of thickness of the envelope and its adhesive layers, the material from which the envelope is made can vary substantially in thickness so as to cause major problems with the feeding apparatus designed to continuously feed envelopes into printers.

It is conservatively estimated that in the United States alone the sales of printers for computing use including laser printers, dot matrix printers, daisy wheel printers and thermal printers will exceed 7 million units in the 1987 alone. While there are numerous manufacturers of laser printers, only one manufacturer of laser printers manufactures an envelope feeder. While there are many manufacturers of envelope feeding equipment only a few recognized quality manufacturers of envelope feeding equipment provide envelope feeders for laser printers. One of the problems associated with a laser printer is that the envelope must be oriented in a proper direction for insertion into the laser printer and in most cases the envelope must be provided in a ready or standby state to be fed into the laser printer when the laser printer establishes that another envelope is needed.

It would be extremely desirable to provide an economical and predictably repeatable envelope feeder which may be adapted for use with laser printers as well as other types of printers without the requirement for expensive adaptive hardware.

SUMMARY OF THE INVENTION

It is a principal object of the present invention to provide an apparatus for stripping a single envelope from a stack of envelopes and for successively feeding the individual stripped envelope to an exit means for use by a printer.

It is another principal object of the present invention to provide a novel picker-stripper-feeder for an envelope feeding apparatus which selects and strips a single envelope from a stack of envelopes without missing a feed or double feeding.

It is another principal object of the present invention to provide a magazine for envelopes which is provided with restraining means that prevents movement of the envelopes in the feed direction.

It is another principal object of the present invention to provide envelope stripping means associated with envelope picking means which bypasses the restraining means on the magazine means so as to grasp, strip and separate a single envelope from a stack of envelopes in the magazine means.

It is a further object of the present invention to provide a envelope feeder having exit means which provides either an envelope discharge or a holding means for feeding a printer.

It is another general object of the present invention to provide an envelope feeder having novel exit means including adjustable friction drive means for inserting envelopes into printers with a predetermined adjustable force.

It is another general object of the present invention to provide in an envelope feeder novel exit means having sensor means which senses an envelope leaving the exit means and actuates the drive means for feeding a new envelope into the exit means.

It is another general object of the present invention to provide in an envelope feeder novel sensing means capable of accepting signals from a remote printer requesting delivery of an envelope to the printer.

According to these and other objects of the present invention there is provided in an envelope feeder a magazine for containing a stack of envelopes to be fed to a printer. The magazine contains a retainer which prevents the envelopes from being fed in the feed direction and the novel feeding mechanism includes a picker, a stripper and a feeder which strips an envelope from the magazine by inserting the picker under the leading edge of the flap of the envelope to be fed and strips the envelope from the stack in a direction substantially orthogonal to the feed direction and then feeds the envelope past the retaining means and into the transfer portion of the envelope feeder for passage to the exit means.

DESCRIPTION OF THE PREFERRED EMBODIMENTS

Figure 1:
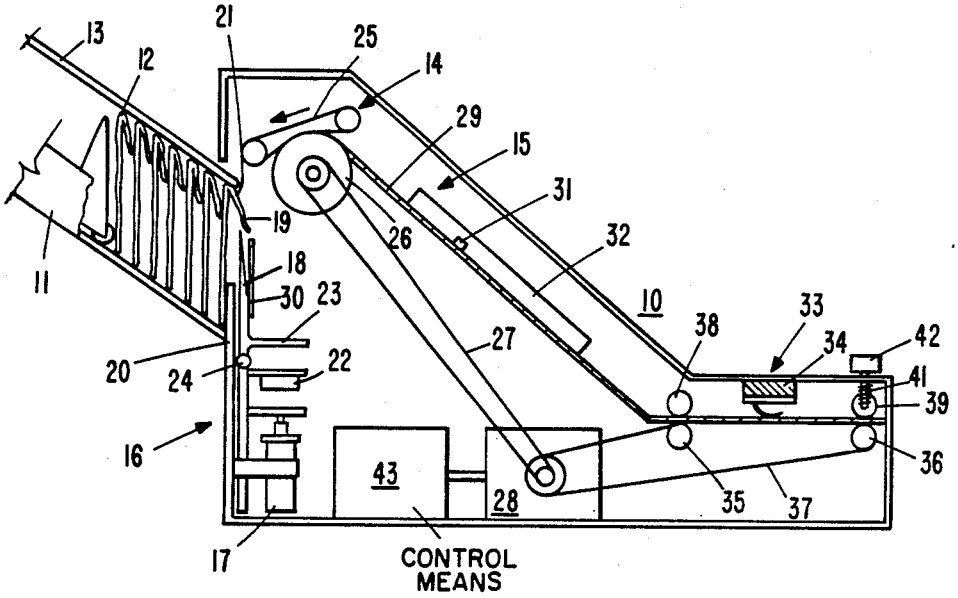
FIG. 1 is a schematic drawing of a flap-down envelope feeder showing in elevation and cross section an inclined magazine and a preferred embodiment picker-stripper-feeder apparatus.

Refer now to FIG. 1 showing in elevation or side view a schematic representation of a preferred embodiment envelope feeder 10 comprising a magazine 11 loaded with envelopes 12 which are to be fed into the feeder 10. Magazine 11 comprises a restrainer 13 shown as a plate which prevents envelopes from being fed vertically from the magazine into the transfer means 14 adapted to receive an envelope 12 and pass it to the track means 15. Retainer baffle 20 positions envelopes 12 for pick up. The picker-stripper-feeder blade 16 is actuated vertically by solenoid 17 to a position which engages forces the picker blade 18 under the flap 19 of envelope 12 so as to engage the picker with the leading edge 21 of envelope 12. Once the picker 18 is in proper position it is moved laterally to the right by electromagnet 22 which pivots arm 23 and blade 18 on pivot 24. When the leading edge 21 of the end envelope 12 is picked to be stripped away from the other envelopes in magazine 11 it is releasably grasped against fingers 30 and is moved free of the retaining plate 13, then fed into the transfer means 14 which comprise a belt 25 which engages with a driven roller 26 driven by belt 27 and motor 28 in the direction shown by the arrow . It will be understood that the solenoids 17 drives the picker blade 18 and envelope 12 into engagement with the belt 25 so as to cause the friction of the belt and cooperating driven roller 26 to pinch and pull the envelope into the transfer means. Once the envelope is engaged into the transfer means 14 the solenoid 17 retracts the picker-stripper-feeder blade and positions it ready for feeding the next envelope. The envelope 12 which is fed into the transfer means is ejected onto the slanting gravity slide 29 of the track means 15 and engages a fixed pivot means 31 causing the envelope to be rotated approximately 90° and to be guided further by adjustable guide means 32 which positions the envelope 12 for entry into the exit means 33. In the preferred embodiment shown, exit means 33 is provided with sensor means 34 which comprises a lever operated microswitch for sensing the absence or presence of an envelope in the exit means. Also in the preferred embodiment the exit means 33 may be provided with drive rolls 35 and 36 driven by a belt 37 and motor 28. The drive rolls 35 and 36 are provided with cooperating pinch rolls 38 and 39. Pinch roll 39 is spring biased through compression spring 41 and adjusted knob 42 which apply pressure to the shaft of the pinch roll 39. Control means 43 is provided to actuate motor 28, solenoid 17, electromagnet 22 etc. in response to sensing means 34 or a signal from a remote printer.

Figure 2:
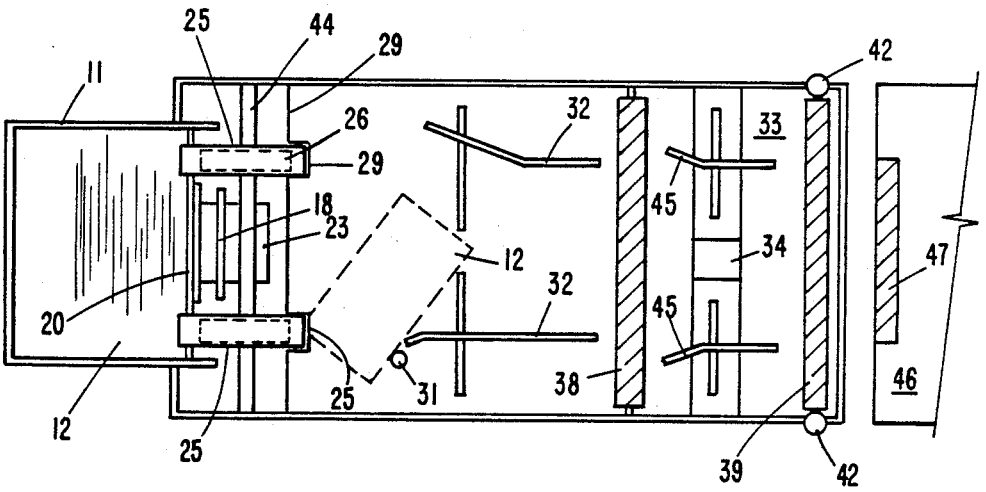
FIG. 2 is a schematic drawing and top view of the envelope feeder of FIG. 1.

Refer now to FIG. 2 which is a top view of the feeder of FIG. 1. The restrainer 13 is removed from the magazine 11 showing the envelopes 12 therein pressing against retainer 20 and the picker blade 18 of the picker-stripper-feeder. Rollers 26 are shown mounted on shaft 44 for feeding an envelope 12 onto slide 29 which is provided with a fixed pivot means 31 that pivots the envelope 12 (shown in phantom lines) into the adjustable guide means 32. Adjustable guide means 32 complete the alignment action and rotate the envelope 12 exactly 90° and feed it between the rolls 35 and 38 and into the exit means 33. The exit means 33 are provided with sensor means which comprise the aforementioned lever operated switch 34. Secondary guide means 45 position envelope 12 under sensor means 34 and align the envelope 12 in the pinch rolls 39 and 36 ready for exit into a printer in response to control means 43. As explained hereinbefore, control means 43 can sense that the envelope 12 is being removed from under the sensor means 34 or in response to a signal from an external printer. The external printer or receiving machine 46 may be provided with a gate 47 which holds the envelope 12 in a preferred position prior to opening the gate when an envelope is required for printing. It will be understood that the host machine 46 may supply a signal to the control means 43 if no sensing means 34 is provided at the exit means 33.

Figure 3:
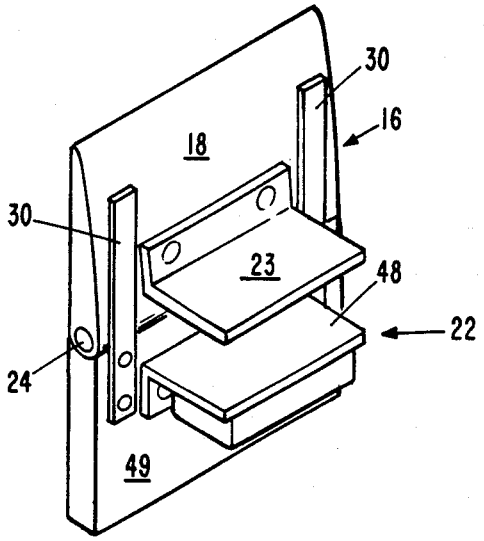
FIG. 3 is a isometric elevation drawing showing schematically an electromagnetic picker-stripper-feeder.

Refer now to FIG. 3 showing an enlarged isometric elevation drawing of the electromagnetic picker-stripper-feeder mechanism 16 of FIGS. 1 and 2. The numbers applied to FIG. 3 are the same numbers applicable to FIGS. 1 and 2 and do not require additional explanation here. The electromagnet 22 is provided with a mounting bracket 48 similar to arm 23 both of which are made of magnetic material. The picker blade 18 of the picker-stripper-feeder 16 and lower slide 49 are preferably made of UHMW-polyethylene or other high density self-lubricating, non-magnetic plastic. It will be understood that the blade 18 and slide 49 are moved in two steps by solenoid 17. The first step causes the picker blade 18 to engage under the flap 19 of the envelope 12. Subsequent operation of the electromagnet 22 pivots blade 18 on pivot 24 to strip the envelope 12 from the stack in magazine 11 and engage fingers 30 which may be mounted on frame 10 or feeder 16 as shown to loosely grasp flap 19. Further linear operation in the vertical direction by solenoid 17 will engage the flap 19 of the envelope 12 into the feed belt 25 of the transfer means 14.

Figure 4:
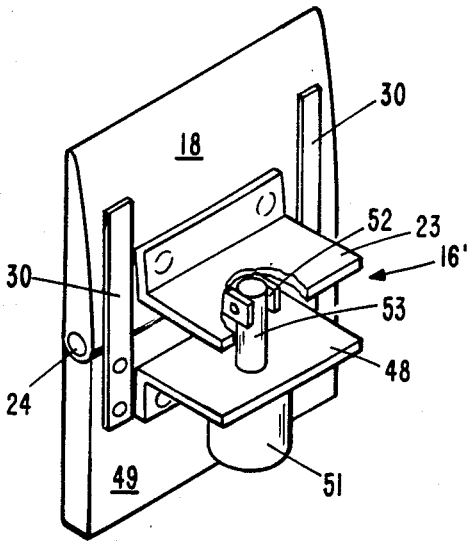
FIG. 4 is an isometric elevation drawing showing schematically an actuated solenoid picker-stripper-feeder.

Refer now FIG. 4 which is an enlarged isometric elevation drawing showing schematically a solenoid operated picker-stripper-feeder. The FIG. 4 modification of the FIG. 3 embodiment may be identical in all respects to the FIG. 3 embodiment and the components are numbered the same except for the substitution of solenoid 51 for the electromagnet 22 and the slotted pivot plate 52 which cooperates with the actuating rod 53 of the solenoid 51. It will be understood that the solenoid 51 has limit stops to provide a desired pivoting movement in the FIG. 1 and FIG. 2 embodiment.

Figure 5:
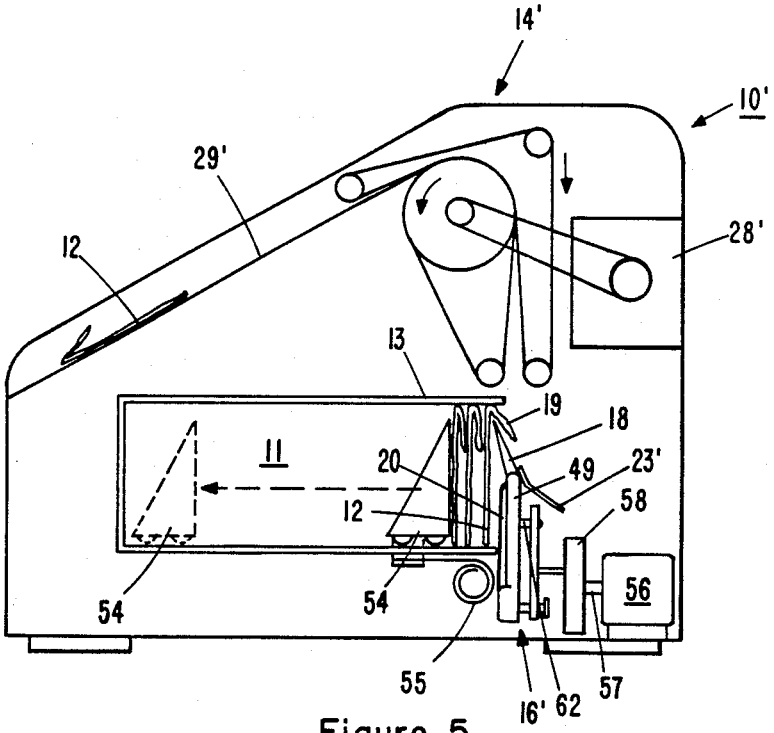
FIG. 5 is a schematic drawing of a flap-up envelope feeder showing in elevation and cross section a horizontal magazine and another preferred embodiment picker-stripper-feeder apparatus.

Refer now to FIG. 5 showing a schematic drawing of a flap-up envelope feeder in elevation and cross section. The envelope feed feeder 10' is provided with a standard horizontal magazine 11 provided with a movable stanchion 54 which is spring bias by spring 55 to urge envelopes 12 into engagement with retainer 20 and picker-stripper-feeder 16' which will be explained in more detail hereinafter. The blade portion of stripper 16' engages under the flap 19 of envelope 12 and articulates so as to bypass the restrainer 13 and engage the envelope 12 into the transfer means 14'. The transfer means 14' is driven by motor 28' in response to control means (not shown). The envelope 12 exits from the transfer means 14' onto a gravity slide 29' so as to provide the envelope 12 having a flap-up orientation at the exit of envelope feeder 10'.

Figure 6:
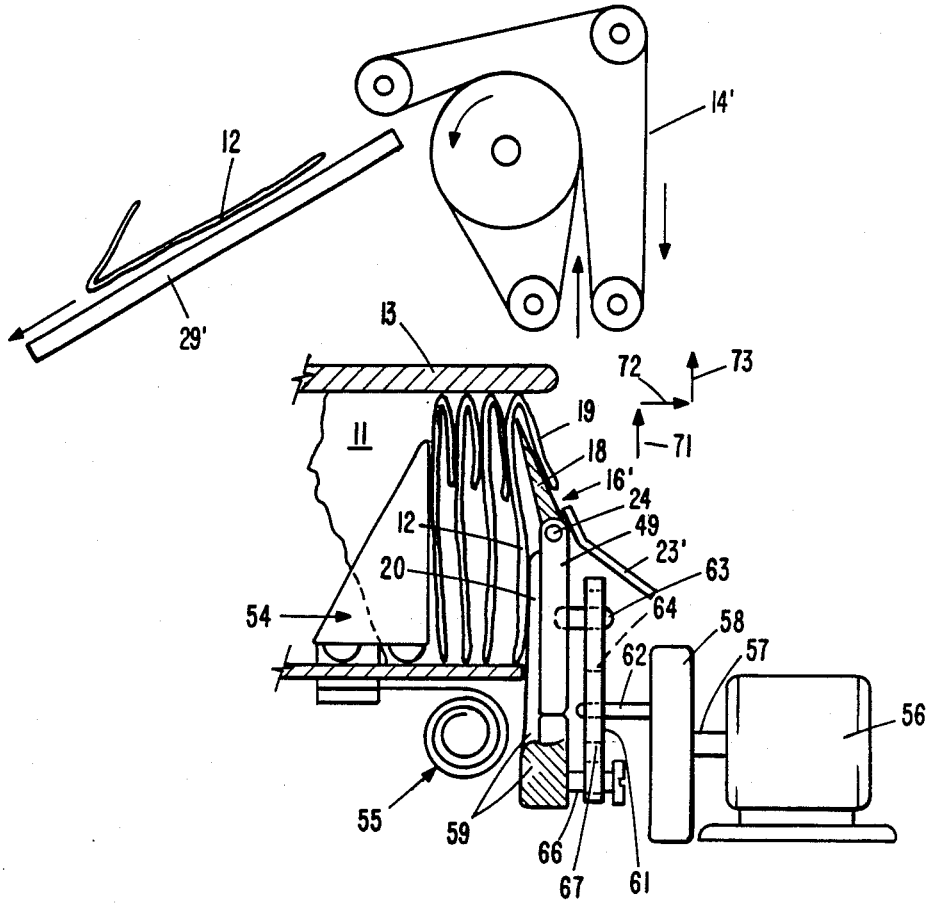
FIG. 6 is an enlarged schematic elevation drawing showing the picker-stripper-feeder of FIG. 5 picking and loading an envelope from a horizontal magazine into the envelope feeder.

Refer now to FIG. 6 showing a drive motor 56 and shaft 57 coupled to a cam 58 adapted to drive and articulate the picker-stripper-feeder 16'. The lower slide 49 of feeder 16' is vertically guided by parallel guides 59 and articulated vertically by slotted lever 61 which is reciprocated by cam 58 and affect pin 62. Cam 58 rotates on shaft 57 and drives lift pin 63 on blade 18 and in a loose slot 64 of lever 61 which is pivoted at pivot 66. Rotational movement of cam 58 lifts feeder 16 vertically by a force applied via pin 62, slot 67 and pin 63 on slide 49. Single cycle motor 56 causes blade 18 to abutt restraining means 13. Then blade 18 is articulated on pivot 24 with motor 56 stopped so as to strip an envelope 12 from the magazine 11. Further, vertical movement of blade 18 feeds the envelope 12 into the transfer means 14' and delivers the envelope 12 flap-up on slanting incline 29'. Further rotation of motor 56 and cam 58 enables the feeder 16' to recover its lowermost position. It will be understood that the motion of the blade 18 is shown by arrows 71, 72 and 73 showing a vertical picking action at arrow 71, a horizontal stripping action at arrow 72 and a vertical feeding action at arrow 73.

Figure 7:
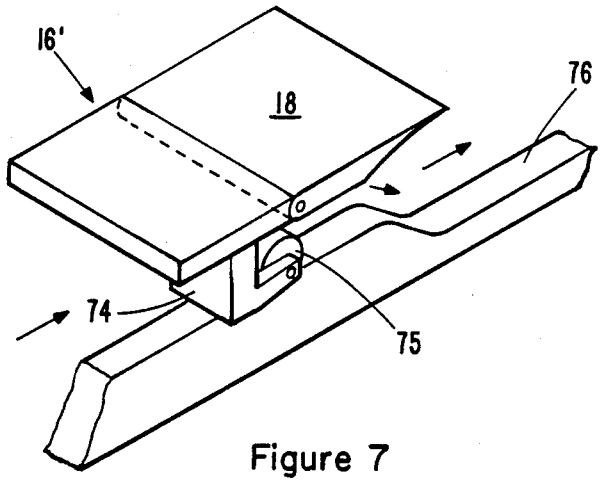
FIG. 7 is an isometric elevation drawing showing schematically yet another picker-stripper-feeder.

Refer now to FIG. 7 showing a simplified and modified linear cam track which may be used in the embodiment shown in FIGS. 5 and 6. The feeder 16' has its picker blade 18 articulated by cam bracket 74 attached thereto and cam roller follower 75 which follows the profile of surface cam 76. It will be understood that the feeder blade 16', 18 is translated in a horizontal direction in FIG. 7 by appropriate drive means such as solenoid 17 shown in FIG. 1.

Figure 8:
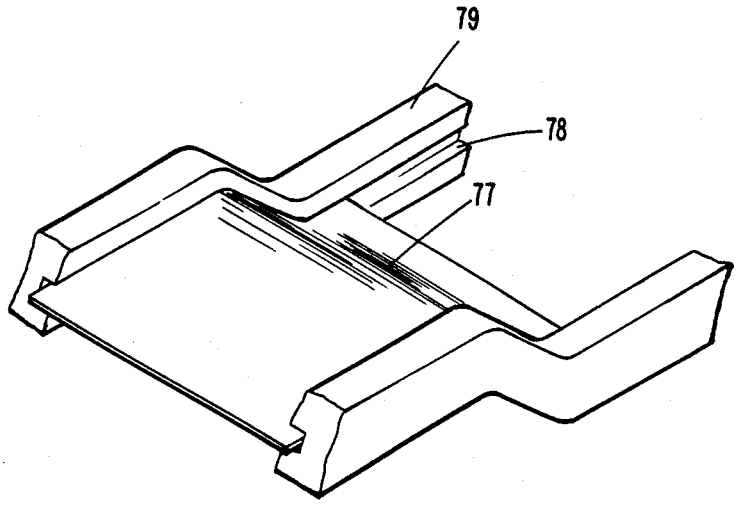
FIG. 8 is an isometric elevation drawing showing schematically yet another picker-stripper-feeder.

Refer now to FIG. 8 showing a picker-stripper-feeder 77 which is made from a sheet of flexible metal that follows in cam track 78 of guides 79. It will be understood that the leading edge of flexible sheet 77 engages under the flap 19 of an envelope 12 whether positioned in a horizontal or vertical direction and is effective to deliver an envelope 12 into transfer means 14 not shown.

Figure 9:
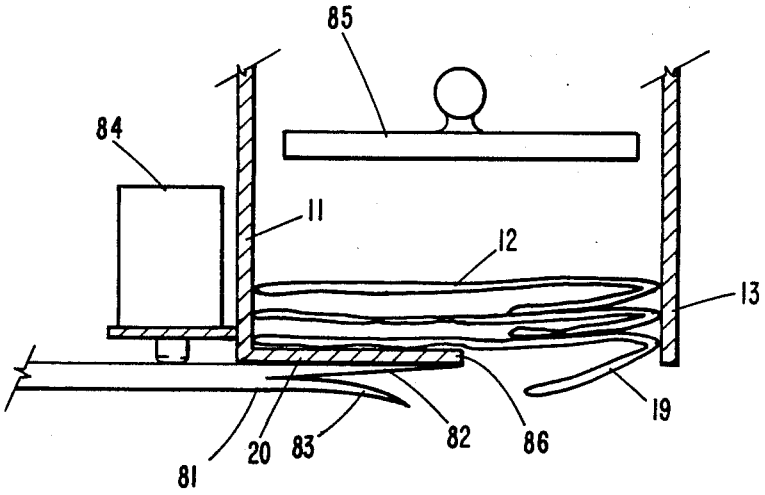
FIG. 9 is an isometric elevation drawing showing schematically yet another picker-stripper-feeder.

Refer now to FIG. 9 showing a modified form of picker-stripper-feeder and a magazine adapted for vertical stacking of the envelopes 12 against retainer 20. The picker 81 is provided with an upper blade 82 and a lower blade 83 which captures the flap 19 when moved horizontally to the right in the feed direction. When the upper blade is engaged against the leading edge of the underside of flap 19, solenoid 84 is actuated by the control means (not shown) so as to impart the stripping action to envelope 12 and to move the flap 19 and the leading edge of envelope 12 below the lower edge of restrainer 13 so that the picker 81 can continue in the horizontal feed direction without engaging the envelope against restrainer 13. It will be understood that the envelope 12 being fed from the bottom of the stack is deformed during the stripping action so as to separate a single envelope 12 from the other envelopes of the stack in magazine 11 and to also position the leading edge of the flap 19 below the restraining means 13 without imparting the same stripping motion to the adjacent envelope 12 so that it is impossible for the adjacent envelope to double feed below the restrainer 13 during the feeding operations. When the magazine 11 is incorporated into the aforementioned envelopes feeders described in FIGS. 1, 2 and 5 a safety plate 85 is preferably employed to apply pressure to the stack of envelopes and to serve as a protection and reminder to an operator attempting to misuse the feeder. It will be understood that the opening 86 in the bottom of the magazine may be shaped to accommodate the flap of various sizes of envelopes to be exposed in opening 86 due to pressure from the stack of envelopes and the safety plate 85. The drawing of FIG. 9 is not to scale and is exaggerated to better illustrate the mode of operation of the invention and it should be understood that the picker 81 operates very close to the body of the envelope 12 so as to always engage under flap 19 and capture the flap 19 for the aforementioned stripping operation.

Having explained a preferred embodiment of the present invention and several embodiments of preferred and modified picker-stripper-feeders it will be understood that the two envelop feeders described in FIGS. 1, 2 and 5 may be modified to incorporate any of the magazines and any of the picker-stripper-feeders so as to satisfy the needs of different forms of envelopes and printers. Equivalent pickers may be actuated by vacuum pneumatic or hydraulic means to pick, strip and feed envelopes by grasping the flap.

A feature of the present invention is to provide a simplified and extremely reliable envelope feeder of the type which may be employed with printers operated under the control of computers. Such printers need to be extremely reliable because during a printing operation malfunction of the envelope feeder results in down time of the more expensive computer which is sometimes dedicated to a single printer or arranged in a configuration of shared computer operation.

The present invention is capable of supplying to a host printer envelopes of different weights, different sizes in either a flap-up or flap-down orientation in any feed direction.

What I claim is:

1. Apparatus for stripping a single envelope from a stack of envelopes and for successively feeding individual envelopes from the stack without double feeding envelopes, comprising:

magazine means for containing a stack of envelopes each having their entire flap exposed when positioned in the feed position at the open end of the magazine means, first restraining means for holding the bottom edge of the envelope, second restraining means fixed relative to said magazine means for restraining the envelope behind to the envelope to be fed from the stack from being moved in the feed direction, picker means having an elongated picker blade operable to be engaged centrally under the leading edge of the flap of the envelope to be fed in the feed direction and for establishing a rigid envelope flap edge to be grasped by said picker blade, envelope stripping means for imparting substantially orthogonal motion to the feed direction to said elongated picker blade to separate the leading edge of the envelope to be fed from the stack of envelopes and to separate the envelope to be fed from said restraining means, said stripping means comprising actuation means for moving said picker blade substantially orthogonal to said feed direction and to grasp and to separate said flap edge from the adjacent envelopes, and drive means for moving said picker means in a feed direction to feed a single envelope from said stack of envelopes without feeding an adjacent envelope from said magazine means.

2. Apparatus for stripping a single envelope as set forth in claim 1 wherein said first restraining means comprises a barrier extending beyond the open end of said magazine means for preventing movement of all said envelopes in said magazine in the feed direction.

3. Apparatus as set forth in claim 1 wherein said actuation means is adapted to pivot said blade of said picker means and to grasp said flap with finger means.

4. Apparatus as set forth in claim 3 wherein said finger means for grasping said flap is mounted on said picker blade.

5. Apparatus as set forth in claim 3 wherein said finger means for grasping said flap is mounted on said apparatus opposite said picker means.

6. Apparatus as set forth in claim 1 wherein said actuation means comprises an electromagnet.

7. Apparatus as set forth in claim 1 wherein said actuation means comprises a cam and cam follow for actuating said blade of said picker means.

8. Apparatus as set forth in claim 7 wherein said cam comprises an offset pin cam driven by an electric motor.

9. Apparatus as set forth in claim 1 wherein said blade of said picker means comprises a bifurcated picker blade for engaging both sides of said flap of said envelope.

10. Apparatus as set forth in claim 1 which further comprises transfer means for receiving an envelope fed from said magazine, and track means operably connected to transfer means for receiving said envelope fed from said magazine means.

11. Apparatus as set forth in claim 10 which further includes orienting means on said track means for changing the direction of feed of said envelopes by approximately 90° .

12. Apparatus as set forth in claim 11 wherein said orienting means comprises a fixed pivotal pin means for engaging an edge of said envelope. at a point to cause said envelope to pivot approximately 90°.

13. Apparatus as set forth in claim 12 wherein said orienting means further includes adjustable guide means for positioning said envelope exactly 90° from its former orientation entering said track means.

14. Apparatus as set forth in claim 10 which further includes exit means connected to said track means and said exit means being adapted to discharge said envelope to a printer or host machine.

15. Apparatus as set forth in claim 10 which further includes friction drive means for receiving and holding an envelope to be fed into said printer.

16. Apparatus as set forth in claim 15 which further includes sensing means for sensing that an envelope has been fed into a printer by said friction drive means and for actuating said drive means to feed another envelope into said transfer means.

17. Apparatus as set forth in claim 16 wherein said sensing means is operable by a signal from an associated printer requesting an oriented envelope.

18. Apparatus as set forth in claim 15 wherein said friction drive means comprises manually adjusting means for adjusting the amount of force imparted to said envelope by said friction drive means.

19. A method of extracting and feeding an envelope having an exposed flap from the open end of a magazine containing a plurality of envelopes without misfeeding or double feeding comprising the steps of:

forcing an elongated picker blade under the flap of an envelope to be removed from said magazine to establish a straight leading edge in the fold flap, stripping and separating the lead edge of said fold flap of said envelope from the other envelopes by imparting a stripping movement to said picker blade so as to strip and separate the straight leading edge of said envelope from other envelopes and to move the leading edge of said flap of said envelope orthogonally past a restraining means adapted to prevent movement of another envelope in the feed direction, imparting a linear motion to said picker blade in the feed direction so as to remove said envelope from said magazine and pass said restraining means and to strip the envelope from adjacent envelopes, and feeding said envelope in a feed direction past said restraining means into transfer means for conveying said envelope to utilization means.

* * * * *